United States Patent [19]

Cummings

[11] Patent Number: 4,508,509

[45] Date of Patent: Apr. 2, 1985

[54] DEVICE FOR MAKING PRESELECTED COMPOSITE DESIGNS

[75] Inventor: Charles A. Cummings, Cincinnati, Ohio

[73] Assignee: CPG Products Corp., Minneapolis, Minn.

[21] Appl. No.: 464,083

[22] Filed: Feb. 4, 1983

[51] Int. Cl.[3] ..... B43L 13/00

[52] U.S. Cl. ..... 434/88; 434/96

[58] Field of Search ..... 46/36, 37; 101/372; 434/81, 85, 87, 88, 96, 155, 174

[56] References Cited

U.S. PATENT DOCUMENTS

| | | | |
|---|---|---|---|
| 1,462,850 | 7/1923 | Clark | 434/155 |
| 2,496,498 | 2/1950 | Shields | 434/174 |
| 2,520,347 | 8/1950 | Talcott | 46/37 |
| 4,445,868 | 5/1984 | Nuttal | 434/88 |

FOREIGN PATENT DOCUMENTS

| | | | |
|---|---|---|---|
| 2807106 | 9/1978 | Fed. Rep. of Germany | 434/81 |

OTHER PUBLICATIONS

"Fashion Plates", and "Mighty Men", pp. 24, 25 of 1979 Tomy Corp. catalog.

"Flip Over Funnies", p. 3 of 1982 Tomy Corp. catalog.

*Primary Examiner*—Harland S. Skogquist

*Attorney, Agent, or Firm*—Gene O. Enockson; L. MeRoy Lillehaugen; Stuart R. Peterson

[57] ABSTRACT

The device comprises a casing composed of a bottom tray having an upstanding pivot post and a hinged cover having an open window. Three concentric flat rings have partial designs embossed thereon to provide raised design portions, the inner ring being rotatable about the post, the intermediate ring rotatable about the inner ring and the outer ring rotatable about the intermediate ring. By individually rotating or angularly positioning the rings relative to each other, any of the partial designs can be radially aligned to form a composite design. After the composite design has been formed, a piece of paper is placed over at least the segments constituting the preselected design. Closing of the cover on the tray clamps the rings in a fixed relation with each other so that the user can then rub a marking implement, such as a colored pencil or crayon, over the portion of the paper appearing in the open window in order to transfer the preselected design onto the overlying paper.

5 Claims, 11 Drawing Figures

DEVICE FOR MAKING PRESELECTED COMPOSITE DESIGNS

BACKGROUND OF THE INVENTION

1. Field of the Invention

This invention relates generally to a device for making various artistic designs, and pertains more particularly to a device utilizing raised design portions that can be individually and selectively oriented to produce a desired composite or overall design.

2. Description of the Prior Art

The closest prior art known to me is embodied in U.S. Pat. No. 3,608,206 granted on Sept. 28, 1971 to Phillip H. Knott for "EXHIBITOR ASSEMBLY FOR IMPRINTING OBSERVABLE MARKINGS ON DISPLAY PLANAR MEANS BY LOCALIZED PRESSURE". The patented apparatus employs various raised portions or segments of a design to be produced through the agency of a pressure-applying member that is rubbed over a flexible recording medium. However, the imprinted design is progressively composed by shifting the various design portions, each of which is in a raised or cameo form, into successive juxtapositions with the design portion that has just been transferred onto the recording medium. Owing to the opacity (or the translucency) of the recording medium, it is planned in the patented structure that several different forms of indexing be resorted to so that the user can shift the desired partial design into proper position so that a composite design will ultimately be constructed or built up from the progressive juxtapositioning of the individual raised design portions. Not only is it necessary to progressively position the partial designs, but it is required that the pressure-applying member be rubbed over whatever partial design portion is in position at any given time prior to shifting the next design portion into adjacency with the one just imprinted.

SUMMARY OF THE INVENTION

A general object of the invention is to produce various composite designs by selecting desired design portions, the preselected combination of design portions then enabling the user to transfer the composite or overall design that he has prepared onto a recording medium. In this regard, it is planned that a number of different design portions be prepared in a cameo or raised form which can be moved into a preselected position relative to each other and when in such a preselected position afford the user the opportunity to reproduce that design in its entirety without having to successively shift the recording medium or having to successively shift the various design portions relative to the recording medium.

A more specific object of the invention is to permit a composite or overall design to be preselected and then readily transferred to ordinary or plain paper. In this regard, it is an aim of the invention to retain the paper in juxtaposition with the design that has been preselected so that all that the user need do is to rub a marking implement, such as a colored pencil or crayon, over the paper to produce the composite design from the raised design portions that he or she has assembled.

Yet another object of the invention is to provide a device of the foregoing character that will be appealing to children of various ages. Stated somewhat differently, it is an aim of the invention to provide a design-producing device that can be easily manipulated by small children and which device will avoid frustration by reason of having the recording medium held in place relative to the composite design that has been selected bv the child. Consequently, it is within the purview of my invention to provide a device that will prove challenging to children of virtually all ages, and at the same time maintain interest over a relatively long period of time. It is also within the contemplation of the invention to obviate the need for parental participation or supervision, a child of even a tender age being able to manipulate the device so as to produce various designs that will give him a sense of achievement.

It is also an object of the invention to cultivate artistic talent in small children, permitting them to preselect various designs from design portions and to even resort to various coloring schemes in producing the composite design from the design portions that he or she has selected.

Also, the invention has for an object the provision of a device for producing composite designs that will be simple to operate, inexpensive to produce and which will be sufficiently rugged that it will be virtually indestructible. Not only is it planned that the device be inexpensive to manufacture, but that the use of conventional paper, together with ordinary colored pencils or crayons, will enable the device to be inexpensively used in that the required materials are of a low-cost character.

Briefly, my invention comprises a plurality of concentric flat rings, each ring having embossed thereon different portions of a possible composite or complete design. By intially rotating each ring so that a selected design portion appears through an open window formed in the casing in which the rings are rotatively disposed, the user can preposition the various rings to form a large number of complete designs through the expedient of angularly prepositioning different desired portions of the designs. Once the composite design has been selected, the concentric rings are maintained in a fixed relationship with each other so that the preselected design appears within an open window in the hinged cover of the casing in which the rings are rotatively mounted. Before closing the cover, the user places a piece of plain paper over the composite design that he or she has selected. After the cover has been closed, access to the paper and the raised design portions therebeneath is had through an open window in the hinged cover of the device. The preselected design is then transferred to the paper without any shifting of the paper or any shifting of the concentric rings, the transfer being accomplished by rubbing a suitable pressure-applying implement, such as a colored pencil or crayon, over the paper visually exposed in the window. When the composite design has been transferred to the paper, the cover is opened and the paper removed. The user can then compose a different design by merely rotating the various concentric rings relative to each other.

DESCRIPTION OF THE PREFERRED EMBODIMENT

Figure 1:
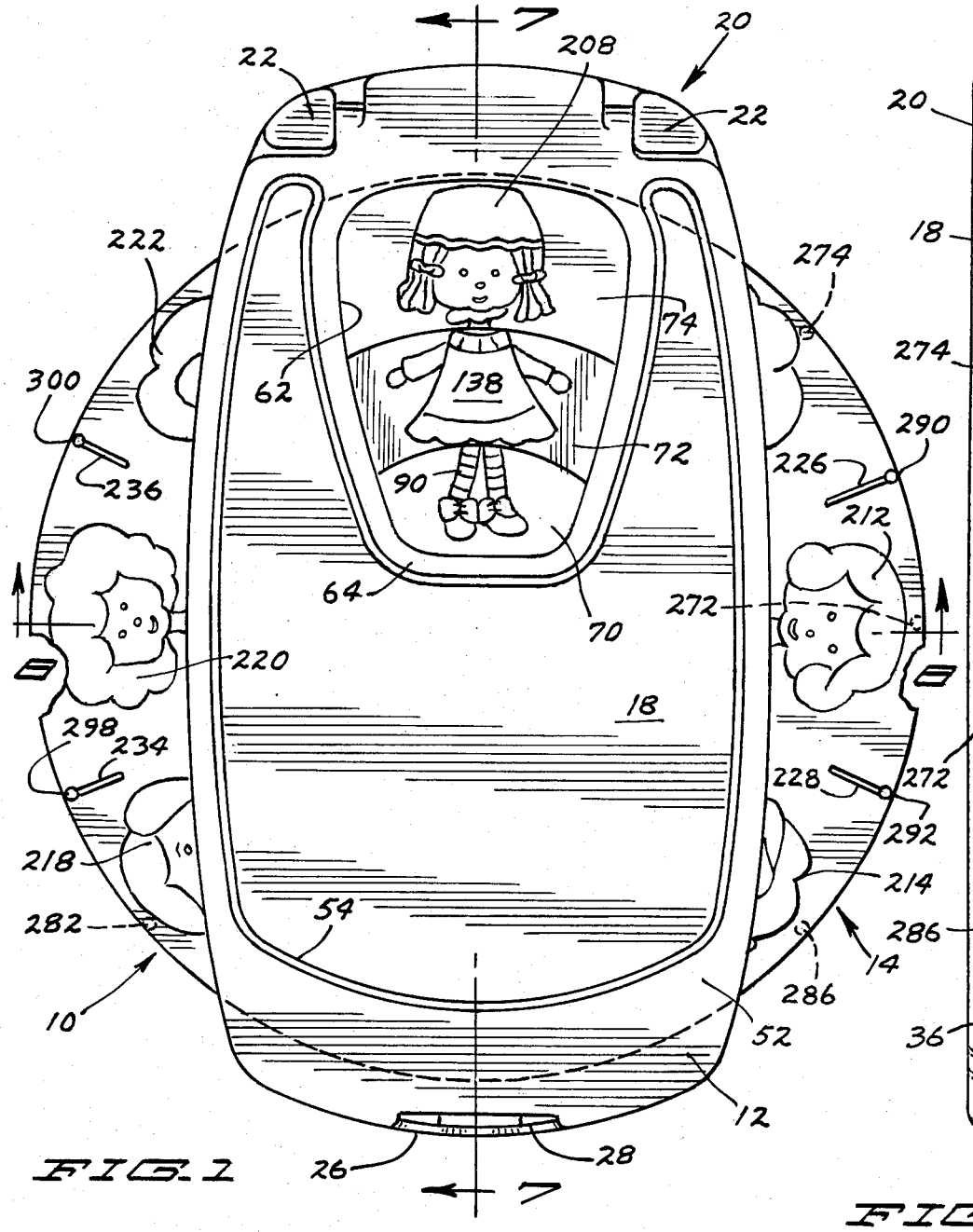
FIG. 1 is a top plan view of my device with a preselected design appearing in the cover's open window, the paper serving as the recording medium which overlies the preselected design having been omitted in order to expose the preselected design to view.
Figure 2:
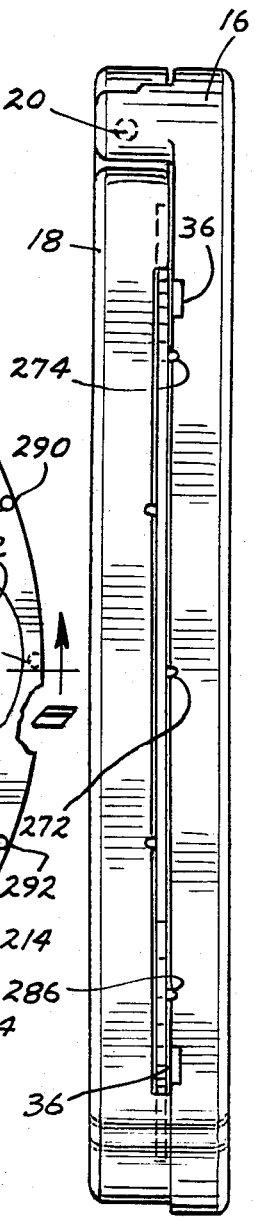
FIG. 2 is a side elevational view of FIG. 1.
Figure 3:
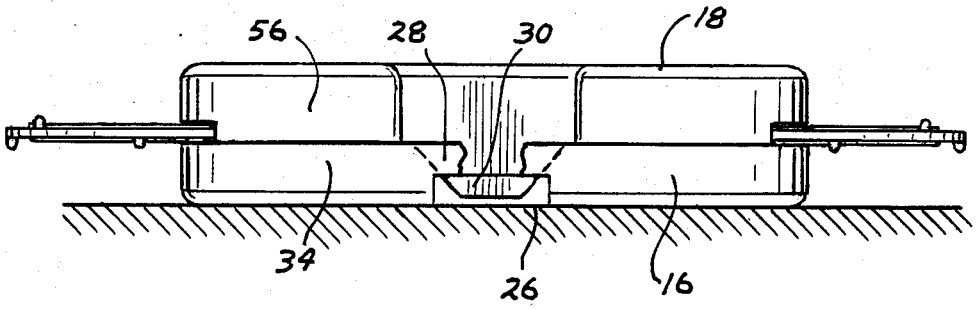
FIG. 3 is an end elevational view depicting the manner in which the hinged casing is latched, a portion of the latch having been removed in order to depict the latching action to better advantage.

The device selected to exemplify my invention has been denoted generally by the reference numeral 10. Basically, the device 10 includes a casing 12 and a plurality of concentric rings collectively indicated by the numeral 14. The casing 12 is comprised of a base member or bottom tray 16 and a top cover or lid 18, the cover being hinged at 20 to the tray 16 by virtue of a pair of laterally-spaced bearings 22 integral with one end of the tray 16 and also by reason of a pair of outwardly directed split pins 24 on the corresponding end of the cover 18.

Whereas one end of the casing 12 is hinged, as indicated by the numeral 20, the other end can be latched at 26, the latch including a catch or keeper strip 28 integral with the tray 16 and a hook or dog 30 integral with the cover 18.

The tray 16 includes a bottom wall 32 and upstanding side walls 34, each side wall 34 having spaced notches 36 for a purpose hereinafter mentioned. Within the tray 16, and above the surface of the bottom wall 32, is a centrally-located panel or platform 38, the panel or platform 38 being in the same plane as the upper edges of the side walls 34. Integral with one end of the panel 38 is an upstanding cylindrical pivot post 40. The panel 38 also has formed therein several detent recesses 42, 44 and 46 that play a role presently to be described. The panel or platform 38 is at a higher elevation than a second panel or platform 48, the second panel or platform 48 being at a lower elevation in order to avoid interference with parts yet to be referred to. Inasmuch as it is planned that the tray 16, and also the cover 18 be molded from a suitable plastic material and have a thickness as thin as practical, a plurality of reinforcing ribs 50 are integrally molded into the tray 16, the ribs 50 extending inwardly from the side walls 34 to the sides of the panels or platforms 38, 48.

Figure 4:
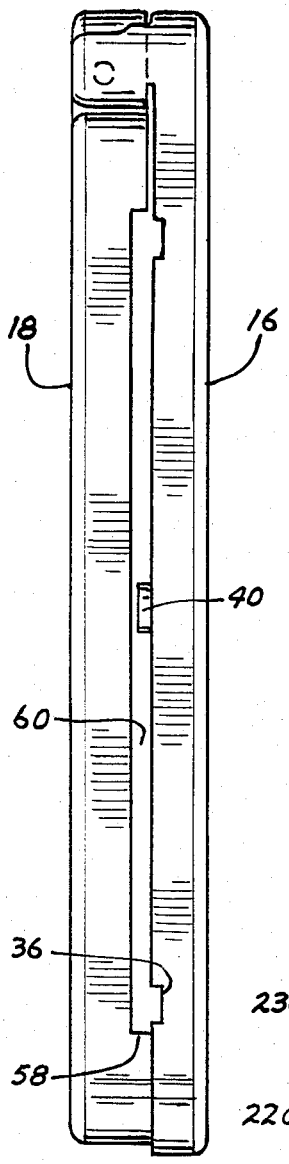
FIG. 4 is a side elevational view corresponding to FIG. 2, but with the several concentric rings removed.

Describing now the lid or cover 18 with greater particularity, it will be observed that the cover 18 includes a top wall 52 having a groove 54 formed therein, the groove 54 imparting an ornamental appearance to the top wall 52, as well as functioning to reinforce the top wall. There are side walls 56 extending downwardly from the top wall 52, the side walls 56 being configured so as to mate with the upstanding side walls 34 of the tray 16 when the casing 12 is closed. Attention is directed to elongated notches 58 in the side walls 56, the notches 58 forming a slot 60 at each side of the casing 12, as can be discerned from the particular slot 60 appearing in FIG. 4.

An open window 62 is provided in the top wall 52 of the cover 18, the open window 62 having a downwardly directed wall 64 terminating in an edge residing in the same plane as the upwardly recessed edges forming the notches 58 in the side walls 56. Supplementing the reinforcing action of the groove 54 and the window wall 64 are three central ribs 66 extending from the window wall 64 to the latch end 26 of the cover 18. Still further, there are two additional longitudinal ribs 68 extending parallel to the centrally-located ribs 66. In this way, the cover 18 is rendered quite rigid, even though it is formed of relatively thin plastic.

Although the concentric rings have been previously herein collectively identified by the reference numeral 14, it will be well to designate the inner ring by the reference numeral 70, the intermediate ring by the reference numeral 72, and the outer ring by the reference numeral 74. The inner ring 70 has a centrally-located hole or opening labeled 76 which has a diameter slightly greater than that of the cylindrical post 40, whereas the intermediate ring 72 has a larger opening 78, the diameter of the opening 78 in the intermediate ring 72 corresponding generally to the outside diameter of the inner ring 70. The outer ring 74 has an opening 80 that corresponds to the outside diameter of the intermediate ring 72.

It will be well to describe the inner ring 70, as well as the other two rings 72 and 74, in greater detail, particularly in order that the function performed by each ring 70, 72, 74 will be fully understood. In this regard, it is to be noted that the inner ring 70 has four raised partial designs 88, 90, 92, 94 embossed thereon. These designs are of a cameo nature, involving what amounts to a number of upstanding ribs that are molded on the upper side of the inner ring 70. Whereas relatively complicated design patterns are contemplated in the actual production of our device 10, it will simplify dramatically the drawings to portray simple body configurations that can be radially aligned in accordance with the artistic desires of the user. Hence, the four partial designs 88–94 on the upper side of the inner ring 70 are only exemplary, as can be well appreciated.

To visually assist in the angular positioning of the partial designs 88–94, four radial ribs 96, 98, 100 and 102 extend upwardly from the topside of the ring 70, but not to the height that the upper edges of the ribbed partial designs 88–94 extend to. In other words, the surfaces of the raised partial designs 88–94 reside in one plane and the radial ribs 96–102 reside in a plane slightly lower or beneath the plane of the upper edges of the partial designs 88–94.

In order to provide a relatively large number of partial designs, it is intended that the underside of the inner ring 70 be formed with four additional partial designs 104, 106, 108, 110 differing from the partial designs 88, 90, 92 and 94. From FIG. 9, it will be discerned that the designs 88–94 on the upper side of the inner ring 70, while being quadrantly located, are angularly offset with respect to the partial designs 104–110 on the lower side of the inner ring 70. Thus, radial ribs 112, 114, 116 and 118 formed on the underside of the inner ring 70 correspond in function to the radial ribs 96–102 on the upper side, being angularly displaced or offset by 45°. The reason for this will presently be explained.

Figure 5:
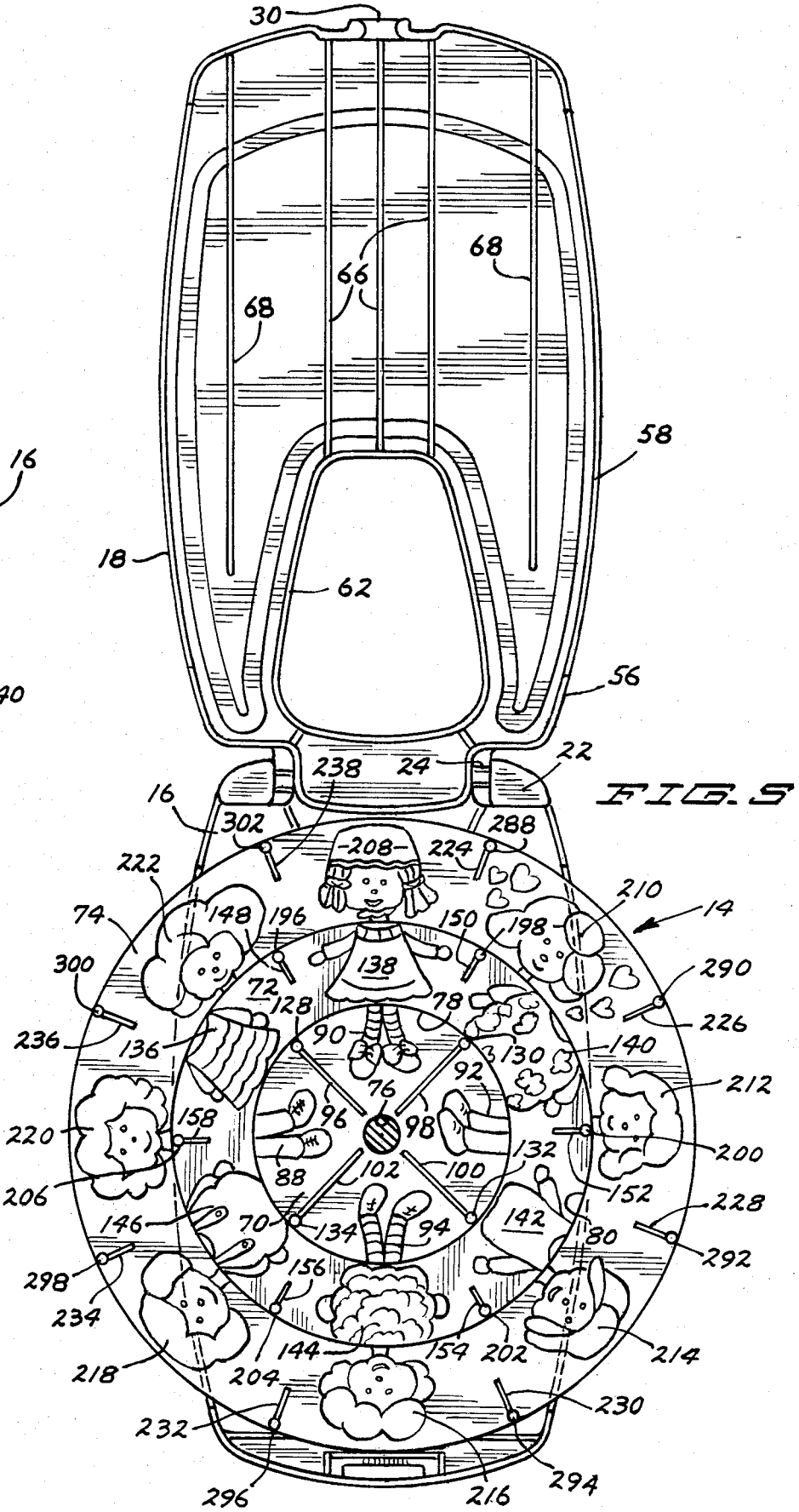
FIG. 5 is a top plan view of our device with the hinged cover opened into a 180° relationship with the bottom tray on which the concentric rings are mounted.
Figure 6:
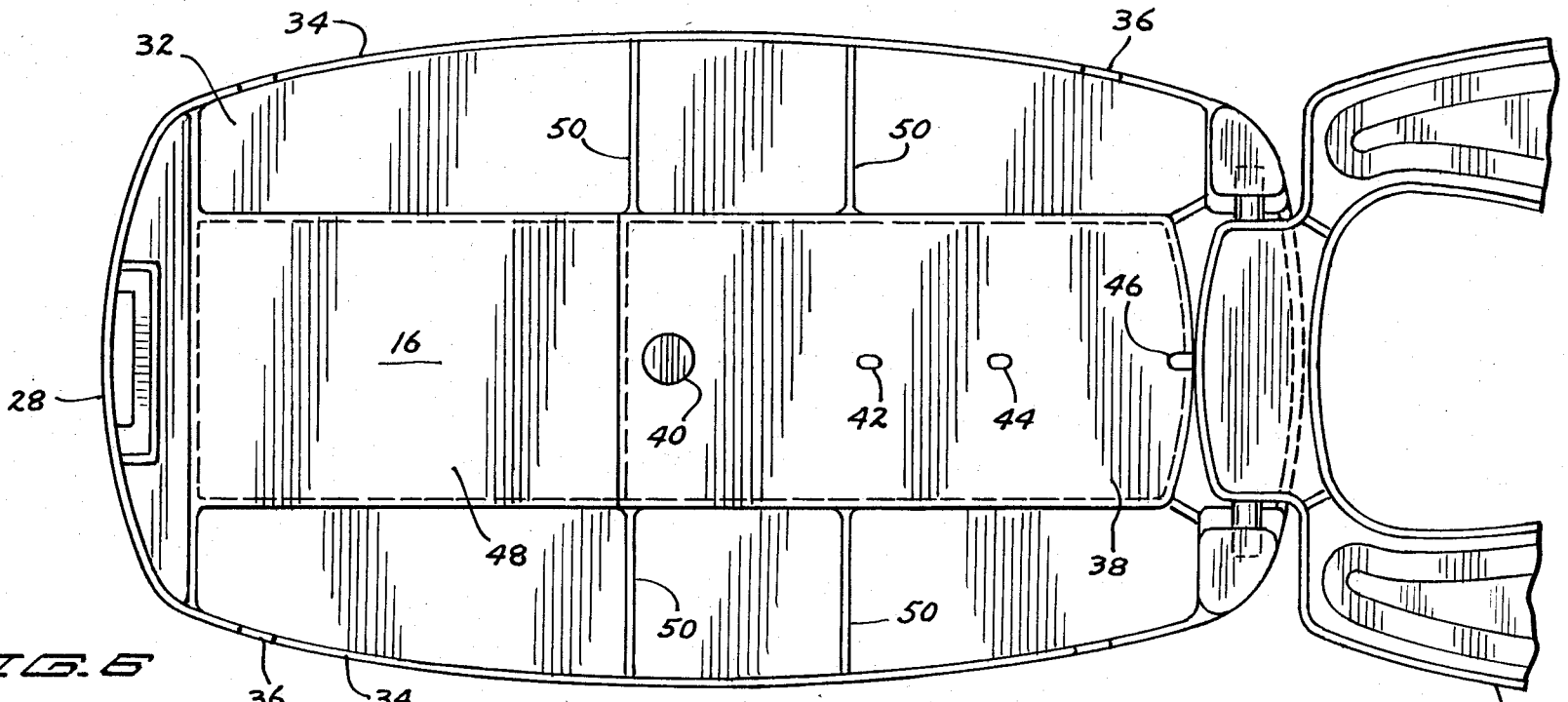
FIG. 6 is a top plan view corresponding to FIG. 5 but with the concentric rings removed as in FIG. 4, the cover being only fragmentarily illustrated in this view in that FIG. 5 illustrates the underside of the complete cover.
Figure 7:
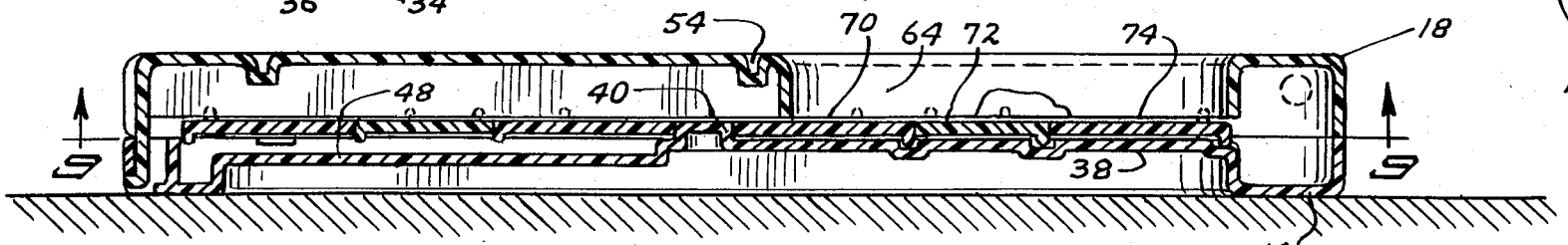
FIG. 7 is a longitudinal sectional view taken in the direction of line 7—7 of FIG. 1.
Figure 8:
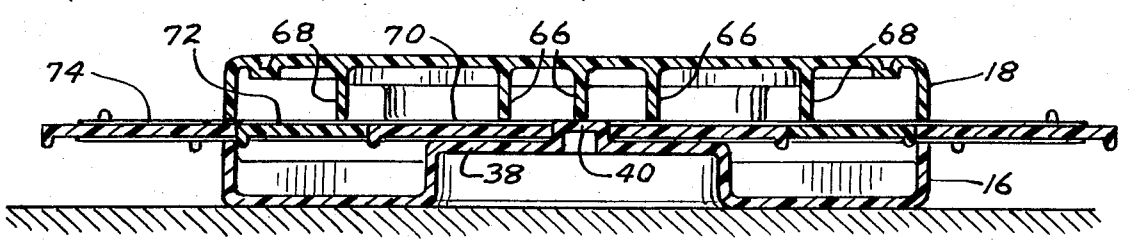
FIG. 8 is a transverse sectional view taken in the direction of line 8—8 of FIG. 1.
Figure 9:
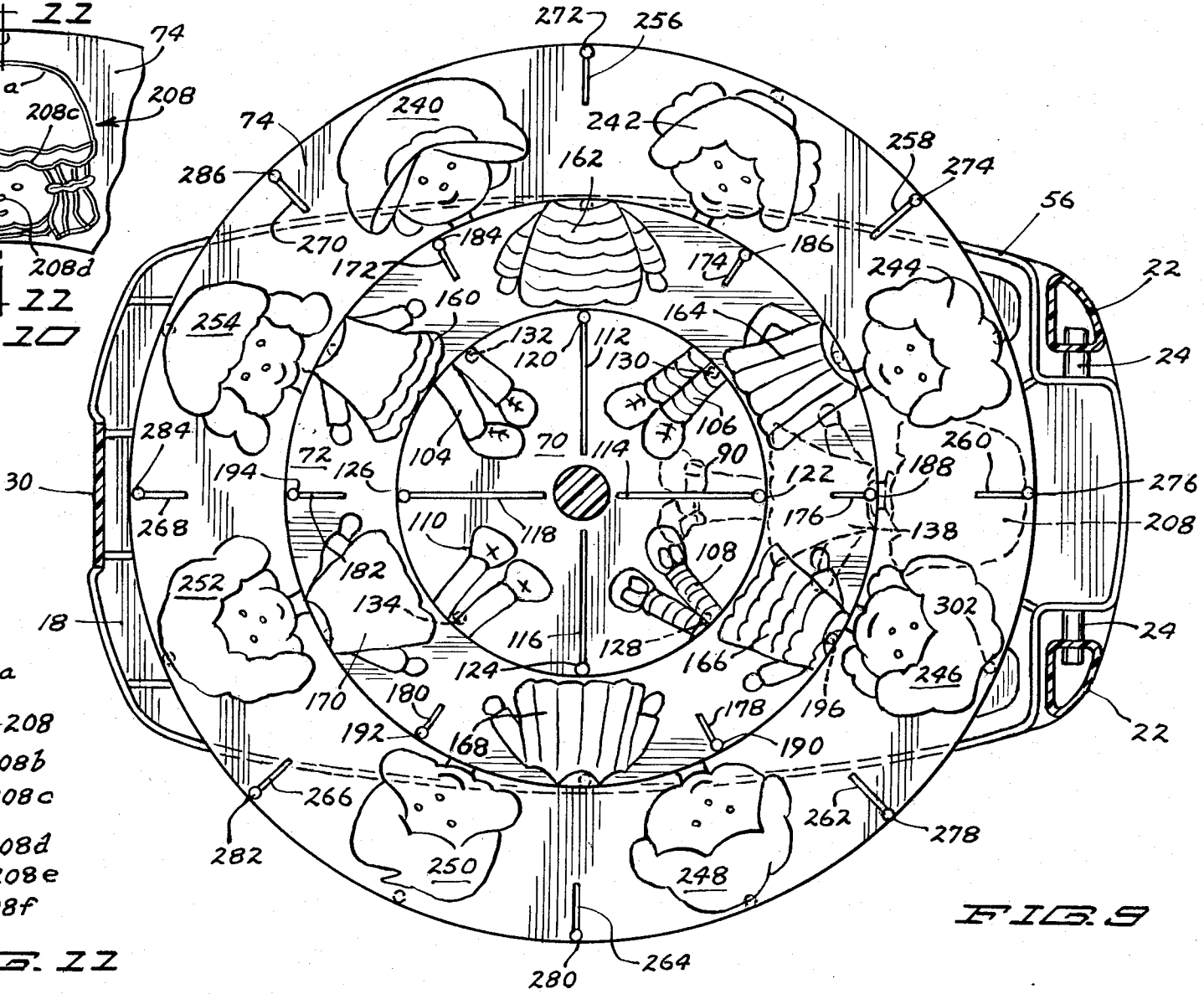
FIG. 9 is a bottom plan view of the concentric rings, the view actually being taken in the direction of line 9—9 of FIG. 7 and therefore showing the base of the cylindrical post in section.

At this time, attention is called to four alignment or detent pins 120, 122, 124, and 126 on the underside of the inner ring 70, these pins 120–126 not being visible in FIG. 5 but do appear in FIG. 9 in that FIG. 9 constitutes a bottom plan view of the inner ring 70. By the same token, there are four alignment or detent pins 128, 130, 132, 134 on the upper side of the inner ring 70. Here again, the detent pins 128–134 and 120–126, respectively, are angularly displaced in relation to each other by an angle of 45°.

Turning now to a description of the intermediate ring 72, it will be perceived that in this instance there are six raised partial designs 136, 138, 140, 142, 144 and 146 on the upper surface thereof and six radial ribs 148, 150, 152, 154, 156 and 158 which are considerably shorter than the previously-mentioned radial ribs 96, 98, 100 and 102 on the inner ring 70. The ribs 148–158 visually facilitate the angular positioning of the intermediate ring 72 relative to the inner ring 70. Likewise, there are six raised partial designs 160, 162, 164, 166, 168 and 170 on the bottom side of the intermediate ring 72 and six radial ribs 172, 174, 176, 178, 180 and 182 thereon.

In this instance, the intermediate ring 72 has six alignment or detent pins 184, 186, 188, 190, 192 and 194 formed on the bottom side thereof and six alignment or detent pins 196, 198, 200, 202, 204 and 206 formed on the upper side thereof, the pins 184–194 on the bottom side being displaced or angularly offset 30° with respect to the pins 196–206 on the upper side, as are the partial designs 136–146 on the bottom side with respect to the partial designs 88–94 on the upper side.

As far as the outer ring 74 is concerned, it is to be observed that there are eight raised partial design portions 208, 210, 212, 214, 216, 218, 220 and 222 formed on the upper side in this instance, and eight ribs 224, 226, 228, 230, 232, 234, 236 and 238 used in properly positioning the various partial designs. On the lower side of the outer ring 74 are eight additional raised partial designs 240, 242, 244, 246, 248, 250, 252, and 254 as well as eight additional radial ribs 256, 258, 260, 262, 264, 266, 268 and 270.

In this situation, there are eight alignment or detent pins 272, 274, 276, 278, 280, 282, 284 and 286 on the lower side and eight such pins 288, 290, 292, 294, 296, 298, 300 and 302 on the upper side of the outer ring 74. Owing to the larger number of partial designs 224–238 and 240–254 on the outer ring 74, the partial designs 224–238 on the upper side of the outer ring 74 are displaced 22.5° relative to the designs 240–254 on the lower side, as are the pins 272–286 and 288–302 with respect to each other.

For purposes of illustration, one design has been shown in dotted lines in FIG. 9. This design appears in solid line on the upper side of the rings (see FIGS. 1 and 5) and it includes the partial designs 90, 138 and 208.

It has already been pointed out that relatively simple design configurations have been selected in order to illustrate my invention. In actual practice, it will be understood that more intricate composite designs of animals and/or machines, as well as human beings, might be embossed on the faces or sides of the rings 70–74. Consequently when the rings 70–74 are relatively rotated so as to bring the various design portions thereon that are to constitute a complete or composite design of a person, animal and/or machine (or for that matter any other composite design) into angular registry, then the complete design will be presented for transfer to the recording medium, preferably plain paper, that is placed over the composite design composed of the various partial designs that have been selected and angularly oriented within the open window 62.

Figure 10:
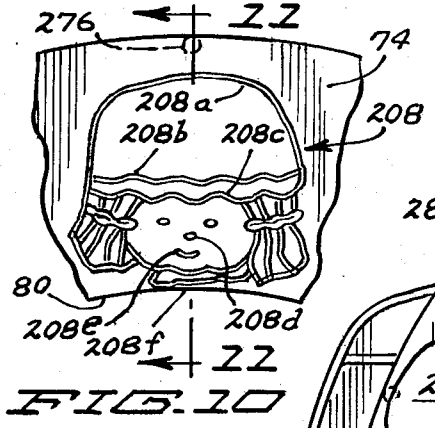
FIG. 10 is an enlarged partial view by a portion of the outer concentric ring, which shows the head portion of a doll.
Figure 11:
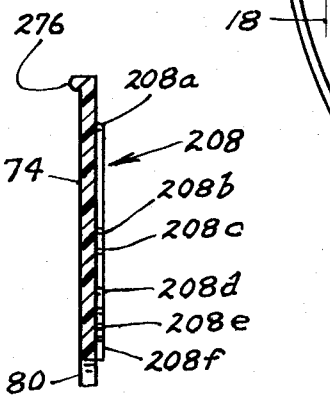
FIG. 11 is a detail sectional view taken in the direction of line 11—11 of FIG. 10.

Although the cameo, ribbed or raised effect made use of in forming the various design portions should be understandable from the description that has been presented, it may be of benefit to consider FIGS. 10 and 11 which depict a fragmentary segment of the outer ring 74. The selected segment shows only the design portion 208 embossed on the upper side thereof, the parts of the design portions on the lower side, that is, to the left as viewed in FIG. 11, having been omitted for simplicity. In other words, parts of the design portions 244 and 246 would appear at the left in FIG. 11 if presented. The ribs constituting the design portion 208 of FIGS. 10 and 11 have been labeled 208*a*, 208*b*, 208*c*, 208*d*, 208*e* and 208*f* so that the cameo construction can be fully appreciated.

In using my device 10, it will be recognized that the inner ring 70 can be rotated so as to present any one of the raised partial designs 88–94 or 104–110 at substantially the twelve o'clock position. When so angularly positioned, then the particular alignment or detent pin 120–126 or 128–134, as the case may be, will be registered with the detent hole or recess 76 formed in the more elevated panel or platform 38.

It will be understood that each of the three rings 70–74 is individually rotatable with respect to the other. It is not necessary that the inner ring 70 be first rotated or angularly positioned. Thus, either the intermediate or outer ring 72 or 74, respectively, can be initially positioned with whatever partial design thereon is positioned at the twelve o'clock position, such a position permitting the partial design to be viewed through the open window 62 of the cover 18 when the cover is latched closed.

Assuming that the inner ring 70 has been rotated into a position so as to present a desired partial design 90 and that the intermediate ring 72 is to be angularly positioned relative thereto so as to align the partial design 138 thereon with the partial design 90 on the inner ring 70, then the intermediate ring 72 is rotated with respect to the inner ring 70, the periphery of the inner ring 70, owing to the correspondence in diameter between the outer periphery of the inner ring 70 and the opening 78 of the intermediate ring 72, serves as a bearing or hub for the intermediate ring 72, just as the cylindrical pivot post functions as a bearing providing a rotational axis for the inner ring 70.

After the intermediate ring 72 has been angularly positioned, although it should be emphasized that the order of orienting the respective rings 70, 72, 74 is a choice available to the user of my device 10, the outer ring 74 can be rotated about the intermediate ring 72 so as to bring whatever partial design thereon, such as the partial design 208, into angular alignment with the partial designs 90 and 138 on the inner ring 70 and the intermediate ring 72, respectively.

The foregoing angular orientation of the various partial designs 90, 138 and 208 constitute the composite design appearing through the open window 62 in FIG.

1. However, before the cover 18 is closed, that is, latched by reason of the latch 26 at the end opposite the hinge end 20, one places a recording medium, preferably a piece of plain paper over at least the design to be transferred thereto. In other words, the piece of paper should be of a size at least as large as the size of the open window 62. With a piece of paper overlying the composite design to be recorded on the paper, the user closes the cover 18, the casing 12 then being automatically latched by reason of the latch 26 that releasably retains one end of the cover 18 to the corresponding end of the underlying tray 16.

Although it has not been felt necessary to actually show a piece of paper, it should be understood that when the cover 18 is closed and latched, the lower edge of the window wall 64 presses the paper against segments of the several rings 70–74 and also presses the several rings 70–74 against the more elevated panel or platform 38. The three centrally-disposed ribs 66 on the underside of the top wall 52 of the cover 18 also press against the paper, forcing the several rings 70–74 downwardly against the upper panel or platform 38. To a lesser degree, the laterally-spaced additional ribs 68 bear against the paper and assist to some degree in resisting rotation of the rings 70–74 relative to each other. It is important to appreciate, however, that the rings 70–74 are literally clamped in a fixed angular relationship with each other, the fixed relationship assuring that the several partial designs 90, 138 and 208 constituting the preselected composite design, will not shift during the ensuing marking operation. In this regard, it will be recognized that the downward pressure exerted by the window wall 64, the central ribs 66 and the additional ribs 68 all act in concert to maintain the detent pins 122, 188 and 276 in the particular detent recesses or holes 42, 44, 46, respectively, these detent pins 122, 188 and 276 engaging or extending into the recesses 42, 44, 46 and a result of selecting the partial designs 90, 138, 208 that are to make up the overall or composite design.

Having anchored the three rings 70, 72, 74 in a fixed relationship, as explained above, the device 10 is now in readiness for transferring the assembled or composite design appearing in the window 62 onto the overlying paper.

It should be apparent that the notches 36 in the side walls 34 of the tray enable the detent pins 272–286 or 288–302, as the case may be to pass the side walls 34 without interference when the outer ring 74 is rotated. It should also be appreciated that the size and shape of the open window 62 is such that only one composite design will appear and thus only one complete design will be transferred without including any fringes from adjacent undesired designs. The paper has not been shown inasmuch as it would only camouflage and conceal what should be visible in order to have a full understanding of the benefits to be derived from a practicing of our invention. However, with the paper clamped over the composite design, all that the user need do is to insert a pressure-applying implement, also not shown, through the open window 62, pressing on the upper side of the paper so as to form an imprint of the underlying design. For instance, the curvature of the ribs 208*a*, 208*b*, 208*c*, 208*d*, 208*e* and 208*f* constituting the design portion 208 would be transferred to that portion of the paper bearing against the upper side of this particular design portion 208, that is, when the paper (not shown) is pressed to the left as viewed in FIG. 11. It is intended that the implement be a colored pencil or crayon, although it could be an ordinary lead pencil if only an uncolored design is to be produced. It is very important to appreciate that in transferring the composite design to the paper, the paper does not have to be shifted relative to the rings 70–74 and the rings 70–74 do not have to be shifted relative to the paper.

In other words, the progressive or successive transpositioning technique required with the apparatus described in the aforesaid Knott patent is not required when practicing the teachings of my invention. This is a decided advantage, especially as far as younger children are concerned, for they do not have to resort to a complex indexing scheme as is necessary with respect to the apparatus of the said Knott patent. Consequently, the user of my device first sees the complete or composite design that he has selectively created and he knows that that design will from that point on be preserved in that the several rings 70–74 are rendered immobile with respect to each other, and also with respect to the casing 12, thereby enabling the preselected composite design to be be transferred to the paper easily and without frustration. Yet, the child experiences a sense of satisfaction in having accomplished a feat which provides a tangible and aesthetic recorded result.

I claim:

1. A device for making reselected composite designs comprising a tray having a panel therein and a cylindrical post extending upwardly from said panel, an inner ring member having raised design portions on the upper and lower sides thereof and having a central circular opening of a size to fit over said post, an intermediate ring member having a plurality of raised design portions on the upper and lower sides thereof and a central opening of a size to fit over the periphery of said inner ring member, an outer ring member having a plurality of raised design portions on the upper and lower sides thereof and a central opening of a size to fit over the periphery of said intermediate ring member, whereby said ring members can be individually rotated relative to said post to angularly position selected design portions in radial alignment with each other and with said panel so that a composite design can be formed, the design portions on the lower sides of said ring members being angularly displaced with respect to the design portions on the upper sides of said ring members, a cover having an open window therein, said cover being hingedly connected to said tray at one end so that said cover can be lowered onto said tray after said ring members have been relatively rotated to form a preselected design, said window being in alignment with said panel and located so as to provide access to said preselected design, a downwardly projecting detent pin on the lower side of each of said ring members aligned with the particular design portion thereabove, an upwardly projecting detent pin on the upper side of each of said ring members aligned with the particular design portion there below, the angular spacing of said detent pins on the upper sides of said ring members and the angular spacing of said pins on the lower sides of said ring members being greater than the width of said window, and said panel having a detent hole for each ring member for receiving therein any one of said detent pins to maintain said ring members in a fixed relationship after said composite design has been preselected by individually rotating said ring members about said post to angularly position selected design portions in radial alignment with each other, said composite design being formed irrespective of when any one of said ring members is reversed as to its upper and lower sides.

2. A device for making preselected composite designs in accordance with claim 1 in which there is a radial rib aligned with each of said detent pins.

3. A device for making preselected composite designs in accordance with claim 1 in which said cover has a wall extending downwardly from said open window so that the lower edge of said wall exerts a clamping action against said ring members to maintain certain of said detent pins in said detent holes.

4. A device for making preselected composite designs in accordance with claim 3 including latch means for releasably retaining said cover in place on said tray after said cover has been lowered onto said tray.

5. A device for making preselected composite designs comprising a plurality of concentric ring members, each ring member having a plurality of raised design portions on one side thereof and each ring member having a second plurality of raised design portions on the opposite side thereof, the design portions on the opposite side of each ring member being angularly displaced with respect to the design portions on said one side thereof, a detent pin intermediate adjacent design portions on said one side of each ring, a detent pin intermediate adjacent design portions on said opposite side of each ring, said detent pins on said opposite side of each ring being angularly displaced with respect to the detent pins on said one side thereof, based means having a single detent hole for each of said rings, and means providing a window in registry with said detent holes so that selected design portions on said one side of said rings can be fixedly positioned for viewing through said window when those detent pins directly opposite said selected design portions are received in said detent holes.

* * * * *